United States Patent [19]

Berthelot

[11] 4,265,443

[45] May 5, 1981

[54] AUTOMATIC LENGTHWISE RECEIVER FOR STACKING PANELS OF DIFFERENT FORM AND SIZE AND METHOD OF USE

[75] Inventor: Daniel Berthelot, Montluel, France

[73] Assignee: S.A. Martin, Villeurbanne, France

[21] Appl. No.: 38,303

[22] Filed: May 11, 1979

[51] Int. Cl.[3] ..... B65H 29/18; B65H 29/68

[52] U.S. Cl. ..... 271/182; 198/425; 271/199; 271/200

[58] Field of Search ..... 271/182, 183, 191, 200, 271/201, 202, 203, 198, 199, 256, 259, 213; 414/901, 43, 91; 93/93 C, 93 DP, 93 M, 93 D, 93 K; 198/422, 425; 209/900

[56] References Cited

U.S. PATENT DOCUMENTS

| | | | |
|---|---|---|---|
| 3,027,817 | 4/1962 | Loeffler | 93/93 DP |
| 3,459,300 | 8/1969 | McGuire | 209/900 X |
| 3,683,758 | 8/1972 | Feldkamper | 414/901 X |
| 3,880,421 | 4/1975 | Muller | 271/259 |
| 3,938,674 | 2/1976 | Kroeze et al. | 271/201 X |
| 3,998,141 | 12/1976 | Hsiue | 271/182 X |
| 4,200,276 | 4/1980 | Marschke | 271/202 X |

FOREIGN PATENT DOCUMENTS

| | | | |
|---|---|---|---|
| 2357456 | 2/1978 | France | 271/182 |

*Primary Examiner*—Bruce H. Stoner, Jr.
*Attorney, Agent, or Firm*—Haseltine and Lake

[57] ABSTRACT

A method of employment of automatic lengthwise receivers which equip continuously operating corrugators. In accordance with the invention the course of the last panel of a first form and size is followed from its arrival upon the receiver, and a change of stack is triggered when this last panel has left the final conveyor of the receiver. Furthermore any retraction of the telescopic device located downstream from first conveyor of the said receiver is stopped.

1 Claim, 5 Drawing Figures

AUTOMATIC LENGTHWISE RECEIVER FOR STACKING PANELS OF DIFFERENT FORM AND SIZE AND METHOD OF USE

FIELD OF THE INVENTION

The present invention refers to a method of employment of machines intended for receiving and stacking panels with a view to their delivery at the output from a continuously operating production or processing machine, when such machines have to deal with panels capable of undergoing at certain times a change of form and size. The invention is applied more particularly by way of example to "automatic lengthwise receivers" located at the end of a "corrugator" or a continuously operating train of machines for the production of a continuous band of corrugated cardboard and the delivery of it in panels by cutting it up both longitudinally and transversely.

BACKGROUND

Automatic lengthwise receivers presently known, for example, such as described in French Pat. No. 2,357,456 by the applicants, employ between the output from the feeder machine and the stack formation station a system of at least two continuous conveyors, a first conveyor receiving at its upstream end the panels leaving the feeder machine and depositing them at its downstream end onto a second conveyor which in turn deposits the panels at the stack formation station, which generally comprises an elevator table having motor-driven rollers. Furthermore such receivers are equipped with means enabling a change of stack to be carried out, these means enabling a stop to be interposed at the output from the second conveyor when a stack is finished, the speed of this second conveyor to be reduced or brought to zero, the finished stack to be discharged, and finally the stop to be retracted and normal speed of the second conveyor to be reestablished when the stacking station is ready to receive the next stack. Furthermore numerous devices of this type are such that the first conveyor includes a telescopic portion downstream, and are equipped with means enabling this telescopic portion to be shifted so that the point of deposit of the first conveyor shifts between two extreme positions always located above the second conveyor; these devices are advantageously in addition equipped with means of causing retraction of the telescopic portion during stack changes, as well as running it out again progressively, starting from the resumption of the formation of the stack.

As employed at present these devices do not enable the problem of the continuous changing of form and size of the panels to be solved in a satisfactory manner, that is to say, without stopping the corrugator. The intermediate stack formed at the end of the output of panels of a first form and size and at the start of the output of panels of a second form and size includes generally panels of both types, which must then be sorted out manually.

SUMMARY OF THE INVENTION

The method of the invention enables this disadvantage to be avoided and hence in the case of a continuously operating machine to ensure the delivery of stacks of panels, each stack including solely panels of the same form and size. It is characterized in that it consists in following the course of the last panel of a first form and size from its arrival upon the receiving and stacking device and in triggering a change of stack when the said panel has left the final conveyor. In addition the speed of movement of the first conveyor is advantageously increased when it has collected the last panel of the first form and size and then afterwards this speed is reduced to a value less than its normal value when the said last panel has left the first conveyor. Preferably, except during stack changes, the speed of movement of the final conveyor is likewise increased at least during the increase in speed of the first conveyor. In the case where a device is employed, the first conveyor of which has a retractable downstream portion, any retraction of the said downstream portion is advantageously stopped for the length of time for which the last panel of a first form and size remains on the final conveyor.

The invention likewise refers to a panel stacking installation equipped with means which enable the putting into effect of the method defined above.

BRIEF DESCRIPTION OF THE DRAWINGS

The invention will be better understood with the aid of the following description of an embodiment, and reference to the attached drawings in which.

DETAILED DESCRIPTION

Figure 1:
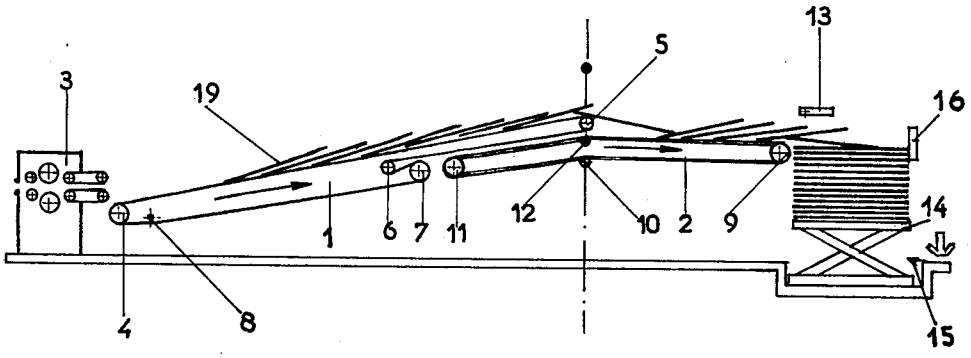
FIG. 1 represents diagrammatically a first phase of the operation of changing the form and size on an automatic lengthwise receiver.

Referring to FIGS. 1 to 4 which illustrate in a very simplified way the method of the invention, the device employed may be recognized as by way of example an automatic lengthwise receiver such as is described in French Pat. No. 2,357,456 by the applicants, and which forms the end of a corrugator for the production of panels of corrugated cardboard.

Such a receiver is placed following a transverse cutter 3 and includes:

a first continuous conveyor 1 consisting in the usual way of a side-by-side array of endless belts which pass in succession over the driving pulleys 4, the delivery pulleys 5 and the return pulleys 6,7,8. The whole is driven from a geared motor unit (not shown) controlled from the general driving motion of the corrugator so as to ensure a ratio less than 1 between the linear speed of the belts of the conveyor 1 and the speed of the band of cardboard in the corrugator. Furthermore as described in French Pat. No. 2,357,456 the pulleys 5 and 6 are integral with a telescopic portion which during stack changes enables retraction of the downstream portion of the conveyor 1;

a second continous conveyor 2 upon which are deposited the panels arriving at the end of the conveyor 1, and consisting, for example, likewise of a set of parallel endless belts. The belts of the conveyor 2 are wrapped round end driving pulleys 9 and return pulleys 10,11,12. The motion of the driving pulleys 9 is likewise given by a geared motor unit (not shown) which in normal running drives the belts of the second conveyor at the same linear speed as the belts of the first conveyor 1. At the downstream end of the second conveyor 1 there is a flap 13 which is normally raised so as to let the sheets pass during normal running and is folded down so as to form a stop which makes an obstacle to the passage of the panels during stack changing periods.

The stacking station proper is formed in the usual way for this species of machine by an elevator table 14 the raising and lowering of which are effected by a hydraulic system which is not shown. The operation of this hydraulic device is likewise in the usual way controlled, for example, by a system of photoelectric cells which detects the upper level of the stack in formation and controls the lowering of the table as the stacking of the panels on the stack proceeds. Furthermore the motion of the table 14 is restricted by at least one end-of-travel stop 15 which is adjustable for height as a function of the stacks to be formed, and which delivers an electrical signal controlling the triggering of the successive cycles corresponding with a stack change. In particular a normal stack change cycle comprises the stopping of the conveyor 2 and the retraction of the telescopic unit (5,6) forming the downstream portion of the conveyor 1, this telescopic unit being run out again afterwards at the resumption of the succeeding stacking.

Finally the stacking station includes a stop 16 adjustable longitudinally according to the form and size of the panels to be put into stacks.

Figure 5:
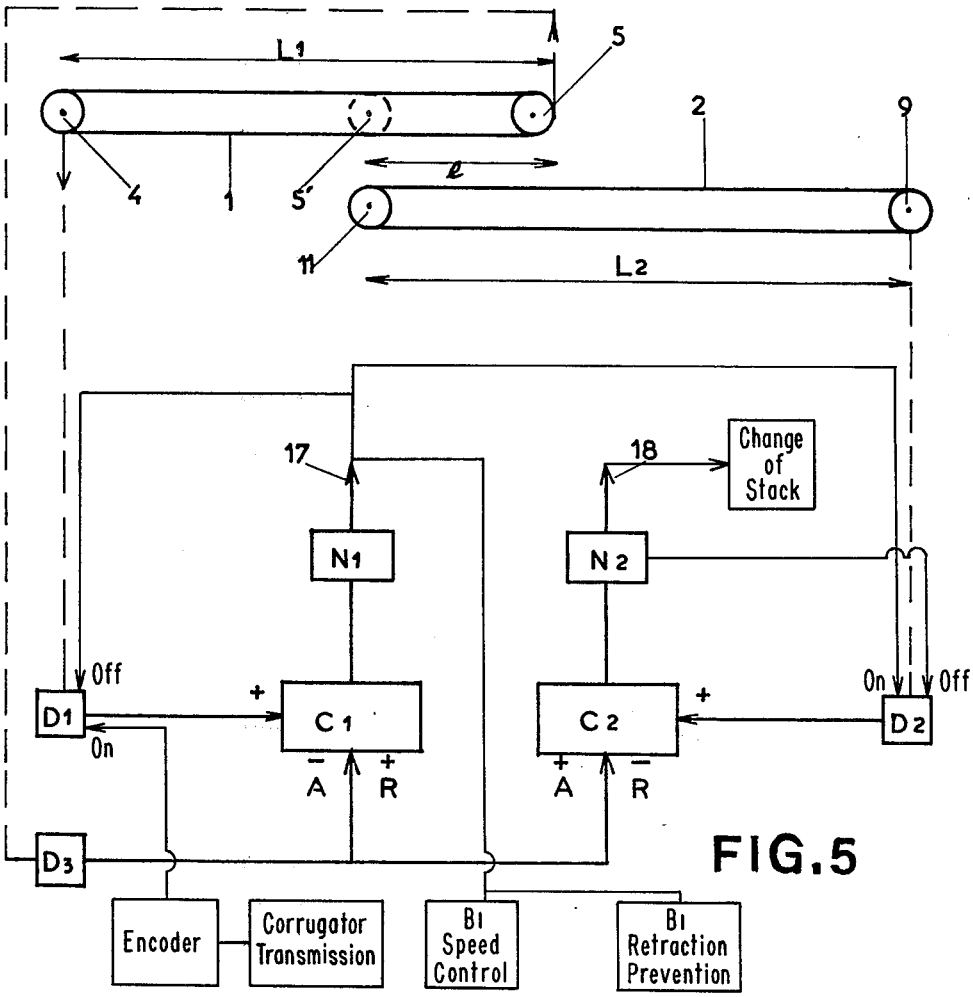
FIG. 5 is a simplified diagram of the electromechanical device which enables the invention to be put into effect.

In FIG. 5 the conveyors 1 and 2 have been represented in a simplified way solely by means of their respective end pulleys (4,5) and (11,9). To each of the pulleys 4 and 9 is coupled a detector, respectively D1 and D2 supplying under operational control one electrical pulse per revolution of the corresponding pulley. Furthermore a position detector D3 is coupled to the end of the telescopic portion carrying the pulley 5 and gives one pulse per length of displacement of the pulley 5 corresponding with one revolution of the latter.

The conveyor 1 conveys the panels over a maximum length L1 corresponding with a number of pulses N1 of the detector D1 and with the pulley 5 being able to retract by a length l until it comes into the position 5', over a minimum length (L1−l) corresponding with a number of pulses from the detector (D1) equal to (N−n), n being the number of pulses for the length of retraction l, and the detectors D1 and D3 being identical. The distance covered between the end pulleys 11 and 9 of the conveyor 2 is equal to L2, corresponding with a number of revolutions N2 of the detector D2. The detectors D2 and D3 being identical and the distance covered on the conveyor 2 varying between (L2−l) and L2, this corresponds with a number of revolutions of the detector D2 varying between (N2−n) and N2,N2 being the number of pulses for the length L2.

As shown in FIG. 5 the pulses from D1 and from D2 are counted by the counters C1 and C2, each having a triggering output (17,18) through respective presettings N1 and N2.

Furthermore the position detector D3 relative to the retractable pulley 5, in the event of an advance of the pulley 5 sends counting pulses to the counter C2 and deduction pulses to the counter C1 and in the event of retreat of the pulley 5 deduction pulses to the counter C2 and counting pulses to the counter C1.

Operation of the whole is as follows:

At the time of change of form and size a coder is set running on the corrugator transmission so that for the machine in question the instant is known with accuracy when the last panel of the first form and size leaves the transverse cutter 3 in order to fall onto the belt 1. In a conventional way by variation of their respective speeds a gap has advantageously been created between the two sheets of cardboard corresponding with the two successive forms.

At the instant when the last panel 19 of the first form and size falls onto the belt 1 a pulse given by the coder associated with the corrugator causes acceleration of the belt 1 as well, advantageously, as that of the belt 2, which corresponds with the phase represented in FIG. 1. During this phase the receiver continues otherwise to operate normally, in particular as far as its telescopic system is concerned in the event of a stack change.

Figure 2:
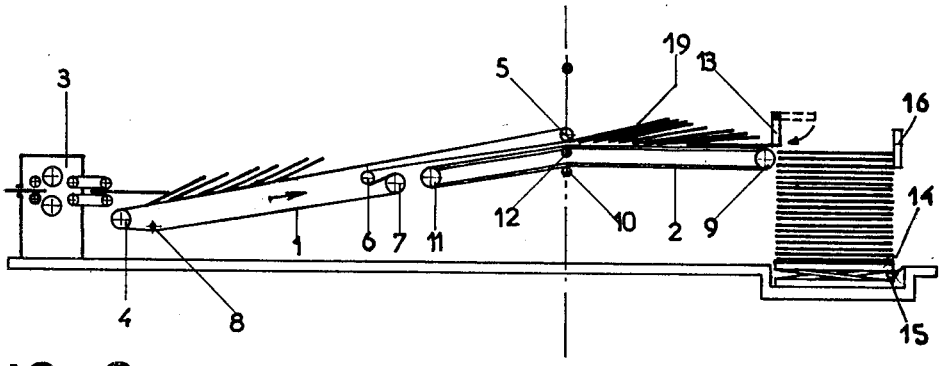
FIG. 2 represents a stack changing operation which comes into play during an operation of changing the form and size in accordance with the invention.

When on the contrary the panel 19 has left the conveyor 1 and has been laid on the conveyor 2, on the one hand the belt 1 is slowed down to a speed distinctly less than its normal speed and on the other hand in the event of a stack change any retraction of the pulley 5 is prevented: this is the phase presented in FIG. 2 which shows a stack change upon the sheets of the first form and size whereas the sheets of the second form and size, being smaller in this example, are already advancing slowly on the belt 1.

Figure 3:
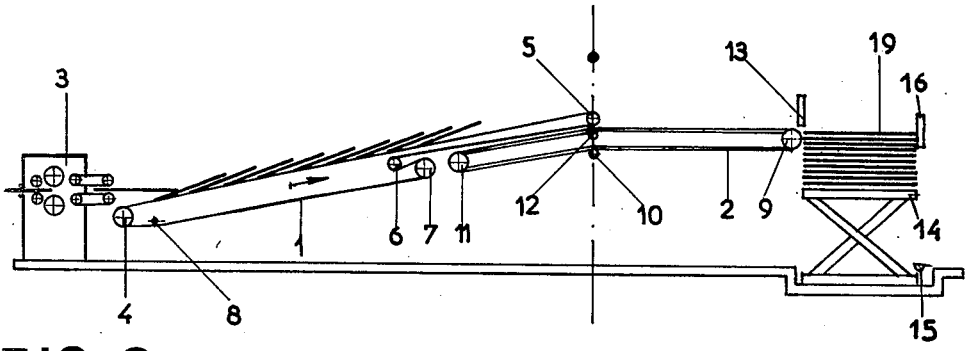
FIGS. 3 and 4 show the last phase of the operation of changing the form and size in accordance with the invention.

When the sheet 19 leaves the conveyor 2 as shown in FIG. 3 a stack change is triggered, that is to say, the sequence of operations normally triggered by the signal emitted from the end-of-travel stop 15.

Figure 4:
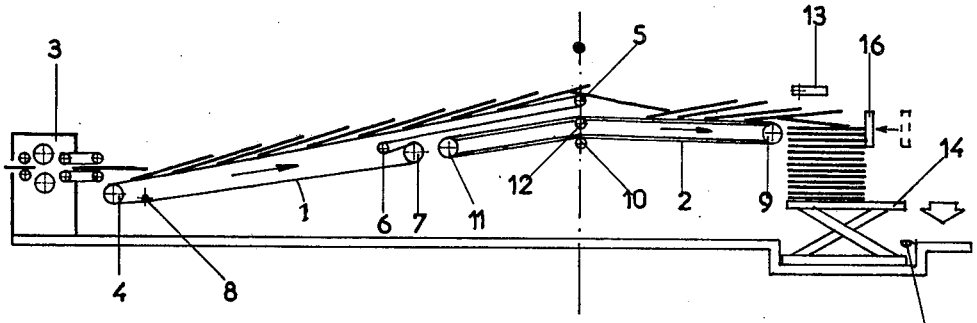

After the discharge of this stack containing the sheet 19 the stop 16 is brought to the position corresponding with the next form and size and the whole of the automatic lengthwise receiver resumes its normal operation with the panels of the new form and size as shown in FIG. 4.

In practice these operations are controlled by means of the counting-deducting device as shown in FIG. 5 in the following way:

It has been seen that the pulse for controlling the acceleration of the conveyor 1 as well, possibly, as the conveyor 2 was given by the coder coupled to the corrugator transmission. Nevertheless as the operation of changing the form and size on the receiver can start at any time including during the course of a stack change, the retractable pulley 5 can at this instant have any position whatever, so that it is necessary to let the counting-deducting device as shown in FIG. 5, coupled to the detector D3, operate permanently, even outside stack change operations.

The method of counting is as follows:

At rest, that is to say, outside the stack change periods, the telescopic member carrying the pulley 5 is advanced to the maximum (the position represented in FIG. 5). Remember that the detector D3 gives pulses corresponding with the displacement of the pulley 5. The presettings of the counters C1 and C2 are respectively the numbers N1 corresponding with L1, and N2 corresponding with L2. The counter C1 reads 0 in counting and the counter C2 reads in counting the number n corresponding with the length l of maximum retraction of the pulley 5.

If a stack change occurs the pulley 5 is shifted towards the left, in the direction towards the position of maximum retreat shown dotted at 5'. The displacement pulses given by D3 are then counted up on C1 and deducted on C2 so that in the position 5' of maximum retreat the counter C1 will read n and the counter C2 will read 0. Conversely when the pulley 5 is to be shifted towards the right the displacement pulses from D3 will be deducted on C1 and counted up on C2.

When the sheet 19 is laid on the conveyor 1, at the same time as the latter is slowed down, operation of the detector D1 is triggered, the pulses from which are likewise counted up on the counter C1.

When the counter C1 reaches the preset value N1, the sheet 19 has then covered the conveyor 1 and falls onto the conveyor 2. A signal leaves the output 17, which controls the slowing down of the belt 1, stopping of the operation of the detector D1, triggering of the operation of the detector D2 the pulses from which are likewise counted up on the counter C2, and stopping of any retraction of the pulley 5.

When the counter C2 reaches the preset value N2, the sheet 19 has left the conveyor 2 and the output 18 sends a signal which controls a stack change operation and stopping of the detector D2. The front stop 16 changes position, starting from the instant when the elevator table 14 rises again after having discharged the last stack of the first form and size, the whole resuming its normal operation until the next change of form and size, when the cycle described above starts again,

I claim:

1. A device intended for receiving and stacking panels with a view to their delivery at the output from a continuously operating production or processing machine having a transmission, the machine being such that it has to deal with panels capable of undergoing at least once a change of form and size, and said device being of the type employing between the output from the feeder machine and the stack formation station a system of at least two continuous conveyors, a first conveyor (1) having a downstream telescopic portion, capable of being retracted and advanced, and receiving at its upstream end the panels leaving the feeder machine and depositing them at its downstream end onto a second and final conveyor (2) which in turn deposits them at the stack formation station, the said device being moreover equipped with means enabling a change of stack to be carried out, these means enabling a stop device to be interposed at the output from the final conveyor when a stack is finished, the speed of the final conveyor to be reduced, the finished stack to be discharged, and finally the stop device to be retracted and normal speed of the final conveyor to be reestablished when the stacking station is ready to receive the next stack, said device comprising a first detector (D1) providing a number of pulses proportional to the distance covered by a last panel (19) of a first form and size on said first conveyor (1), means, connected to said machine transmission, for triggering the operation of said first detector (D1) when said last panel (19) of a first form and size arrives on said first conveyor (1);

a second detector (D3) operating permanently and providing, by an action identical to that of the first detector (D1), a number of pulses proportional to the distance travelled by the downstream telescopic portion (5) of the first conveyor, a first counter (C1) having a presetting, a counting input for the first detector (D1) and a counting or deducting input for the second detector (D3) depending respectively upon whether the telescopic portion (5) is being retracted or advanced;

an output (17) having a presetting and providing a signal when said first counter (C1) posts a number (N1) corresponding to the maximum length (L1) of travel of a panel on said first conveyor, said first counter being set to be normally at zero, in the absence of the operation of the first detector (D1), when the telescopic portion (5) is advanced to the maximum, means connected to said output (17) of said first counter (C1) enabling, at a signal from said output, to command the slowing down of the first conveyor (1) to a speed less than its normal speed, the stopping of the operation of the first detector (D1), the stopping of any retraction of the telescopic portion (5) and the triggering of the operation of a third detector (D2) providing, by an operation identical to that of the first detector (D1), a number of pulses proportional to the distance traveled by a panel on the second and final conveyor (2), a second counter (C2) having a counting input for said third detector (D2), a counting or deducting input for the second detector (D3) depending respectively upon whether the telescopic portion is being retracted or advanced, and an output (18) having a presetting and providing a signal when said second counter (C2) posts the number (N2) corresponding to the maximum length (L2) of the distance covered by a panel on said second conveyor (2), said second counter being set to be normally at a value (N) corresponding to the maximal distance (l) covered by said telescopic portion, in the absence of the operation of the third detector (D2) and when the telescopic portion (5) is advanced to the maximum, and means connected to said output (18) of said second counter (C2) enabling, upon a signal from said output of said second counter, to command the stopping of said third detector (D2) and the triggering of a change of stack.

* * * * *